United States Patent [19]

Adamik

[11] 4,302,892

[45] Dec. 1, 1981

[54] ATHLETIC SHOE AND SOLE THEREFOR

[75] Inventor: Jaroslav F. Adamik, Santa Ana, Calif.

[73] Assignee: Sunstar Incorporated, Garden Grove, Calif.

[21] Appl. No.: 142,476

[22] Filed: Apr. 21, 1980

[51] Int. Cl.[3] ..... A43B 13/14

[52] U.S. Cl. ..... 36/31

[58] Field of Search ..... 36/31, 104, 43, 44

[56] References Cited

U.S. PATENT DOCUMENTS 73,924 1/1868 Pickett ..... 36/31

2,156,532 5/1939 Greider ..... 36/104

4,069,601 1/1978 Robbins et al. ..... 36/104

*Primary Examiner*—Patrick D. Lawson

*Attorney, Agent, or Firm*—Steven Bazerman

[57] ABSTRACT

An athletic shoe having an upper, an outer sole, and an intermediate sole, the intermediate sole being made essentially of a peripheral portion extending the full length of the shoe and underlying the inner and outer peripheral sides and the periphery of the heel, and surrounding an inner core portion. The peripheral portion of the intermediate sole is made of a relatively hard closed cell foam and the core portion is made of a relatively soft closed cell foam.

6 Claims, 8 Drawing Figures

ATHLETIC SHOE AND SOLE THEREFOR

BACKGROUND OF THE INVENTION

This invention relates to athletic shoes, and more particularly this invention relates to a sole construction for athletic shoes.

Nowadays, there is a great emphasis on improving the health and physical well being of men and women alike by indulging in a regular program of exercise. Particular emphasis is placed on running or jogging as a means of exercise which stimulates the heart, improves the respiratory system, and tones a variety of muscles. With this emphasis on running and jogging, however, there is an equally important emphasis on the proper footwear to provide both comfort and protection against injury.

Athletic shoes used primarily for running or jogging have undergone a number of evolutionary changes in their design. Much development has gone into the design of the uppers of the shoes which have reached a stage of development wherein improvements are minor. Current emphasis is placed on weight, flexibility, and sock absorbency of the shoe. These considerations are primarily functions of sole design. There are a great many styles and types of such athletic shoes presently being marketed, most of them providing good foot support and clearly serving the purpose for which they are sold. But, all of them suffer from a common disadvantage, namely, they sacrifice light weight for shock absorbency, or vice versa. Some designs, while attempting to solve the problems inherent in a running shoe, either exacerbate the problems or solve them in a complex manner which adds to the cost of manufacture and, naturally, to the cost of the shoe.

For instance, in U.S. Pat. No. 4,030,213, a construction is disclosed which utilizes a rigid sole extending the full length of the shoe and curving upwardly at the heel end and the toe end to be joined to the upper. The rigid sole member could be made of hard rubber or of metal and is convex to provide a "pedestal" beneath the wearer's arch. A pair of resilent sole members are applied over the rigid sole at the heel end and at the toe end, these resilient members also being convex. The net effect when the wearer takes a step is to provide a double rocking motion. Furthermore, in one embodiment, a number of springs are embedded in the various sole members to provide additional resiliency.

In U.S. Pat. No. 4,128,950, there is disclosed an athletic shoe which is somewhat lighter in weight than other prior art shoes utilizing, intermediate the upper and the outer sole, a heel lift sole layer of resilient lightweight synthetic plastic foam cushioning material and extending under the heel and the arch of the wearer, and an intermediate sole layer of a similar plastic foam material extending the full longitudinal length of the shoe. Both the heel lift sole layer and the intermediate sole layer are made of the same foam material which is preferably a polyethylene having a hardness, A-type, durometer, 68° F. of 35–37, or a polyethylene vinyl acetate having a hardness of 26–29. Because the material of which these layers is made is quite soft, it is necessary to further include a lateral stabilizer plate between the two layers and situated under the wearer's heel. In an alternative embodiment, the heel lift layer (to be distinguished from the heel lift sole layer) has an outer border portion made of a hard crepe rubber surrounding a relatively soft core portion made of a soft foam.

The use of the soft core portion is for the purpose of stabilizing the shoe and the use of the crepe rubber outer portion is for the purpose of providing greater lateral stability.

The disadvantage of this prior art shoe lies in the use of an extremely soft foam which renders the shoe inherently unstable and thereby necessitates the use of a rigid stabilizer plate or a crepe rubber border in the heel and arch area of the shoe thereby adding to the weight and having all the undesirable characteristics of other prior art shoes.

BRIEF DESCRIPTION OF THE INVENTION

It is, therefore, a primary object of the present invention to provide an athletic shoe and sole therefor which are free of the aforementioned and other such disadvantages.

It is another object of the present invention to provide an athletic shoe which gives reasonably firm support along the outer periphery of the shoe as a whole while being light in weight.

It is a further object of the present invention to provide an athletic shoe which is light in weight and provides firm support along the outer edges thereof.

It is yet another object of the present invention to provide a sole construction for an athletic shoe which is light in weight and provides firm support along the outer edges thereof.

Consistent with the foregoing objects, the present invention, in its broadest aspect, is an athletic shoe, and sole therefor, which is light in weight and provides firm support along the outer edges thereof comprising an upper, a hard resilient outer sole, and an intermediate sole which comprises a relatively hard closed cell foam peripheral portion along the entire longitudinal length of the shoe and underlying the outer periphery thereof, and a relatively soft closed cell foam core portion extending essentially along the entire longitudinal length of the shoe. Thus, the peripheral portion of the intermediate sole is essentially U-shaped. More specifically, as is well-known in the art, the shoe includes an upper which is of a conventional construction and made in a conventional manner, a hard resilient outer sole extending longitudinally from the heel end to the toe end of the shoe and curved upwardly in front of the toe portion of the shoe and having a tread design which does not form a part of the present invention, and an intermediate sole member. According to this invention, the intermediate sole member is wedge-shaped and extends longitudinally the full length of the shoe, tapering in thickness from the heel end to the sole end. The intermediate sole member essentially comprises two portions, an outer peripheral portion and an inner core portion. The outer peripheral portion is essentially U-shaped, with the arms of the U being somewhat curved to a shape which is well-known in the forming of shoes in general. It follows the shape of the outer periphery of the shoe. The outer peripheral portion is fabricated of a closed cell foam having a hardness of from about 45 to about 50. The core portion is fabricated of a closed cell foam having a hardness of about 35.

The foam used in the instant invention, both the relatively hard foam used in the outer peripheral portion and the relatively soft foam used in the core portion, is conventional in the art as is described in detail in the aforementioned U.S. Pat. No. 4,128,950, being made of polyethylene or polyethylene vinyl acetate, with the polyethylene vinyl acetate being preferred. The significant difference between the relatively hard foam used for the outer peripheral portion and the foams disclosed in U.S. Pat. No. 4,128,950 is in the hardness. The hardest of the foams disclosed in U.S. Pat. No. 4,128,950 has a hardness of about 35–37 while the relatively hard foam used in the outer peripheral portion in the instant invention has a hardness of about 45 to about 50. This, of course, is well within the skill of the art.

It should be noted that "hardness" as used herein refers to A-type, durometer, 68° F., hardness as discussed in U.S. Pat. No. 4,128,950. It is to be distinctly understood that where "hardness" is mentioned anywhere in this specification and claims, it refers to that standard.

BRIEF DESCRIPTION OF THE DRAWINGS

The aforementioned objects of this invention will be described, and other objects will become apparent, as the following detailed description proceeds, such description making reference to the annexed drawings wherein.

DETAILED DESCRIPTION OF THE PREFERRED EMBODIMENTS

Figure 1:
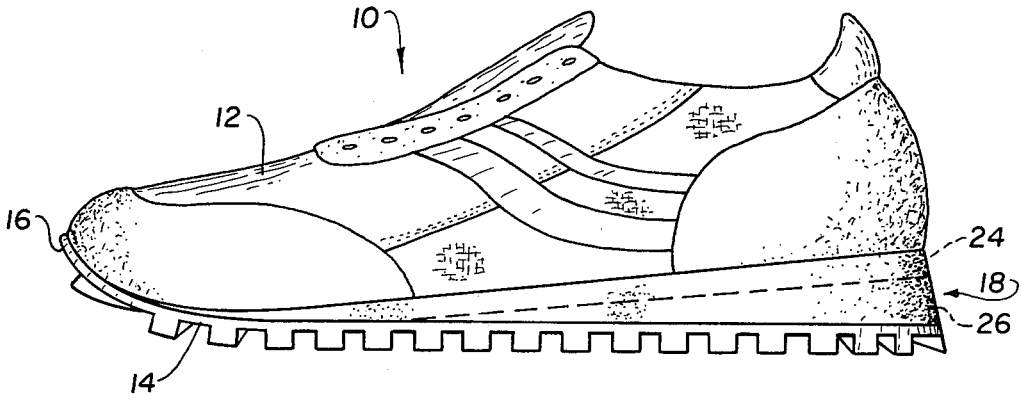
FIG. 1 is a side elevational view of an athletic shoe according to one embodiment of the present invention.

Referring first to FIG. 1, an athletic shoe of a type generally used for running or jogging is generally designated by the numeral 10. Shoe 10, as is conventional, comprises upper 12, outer sole 14 which extends from the heel of the shoe to the toe and then curves upwardly in front of the toe portion as shown at 16, and an intermediate sole generally designated by the numeral 18.

Figure 2:
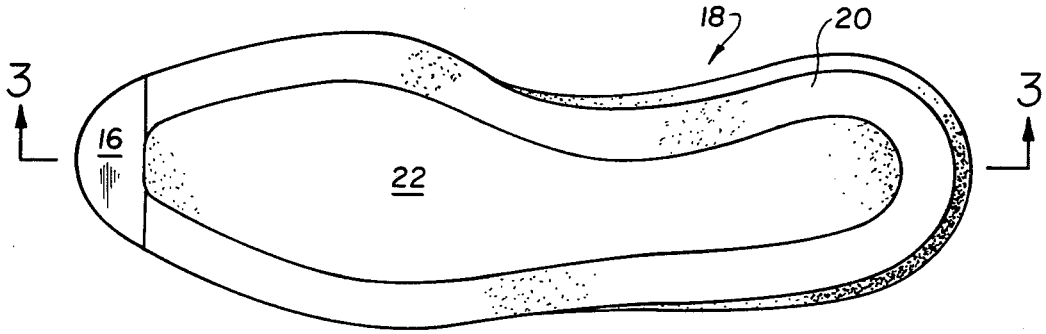
FIG. 2 is a top plan view of the intermediate sole and outer sole of the shoe of FIG. 1.
Figure 3:
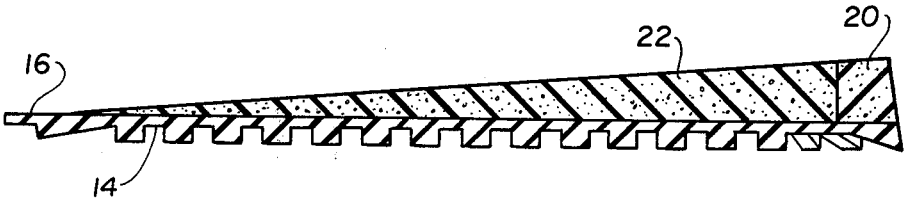
FIG. 3 is a cross-sectional view taken along the line 3—3 of FIG. 2.
Figure 4:
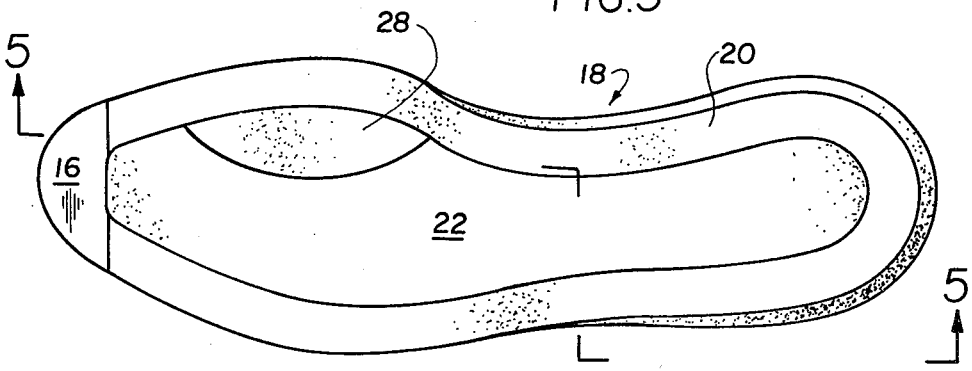
FIG. 4 is a top plan view of another embodiment of an intermediate sole according to the present invention.
Figure 5:
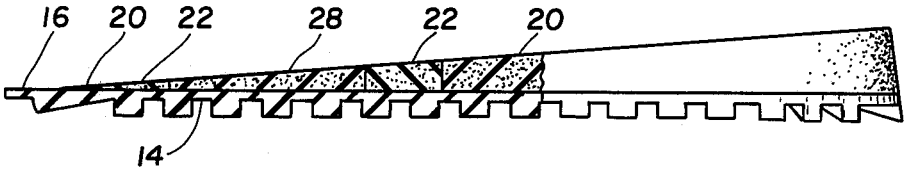
FIG. 5 is a cross-sectional view taken on the line 5—5 of FIG. 4.

Considering FIGS. 2 and 3 in conjunction with FIG. 1, intermediate sole 18 comprises peripheral portion 20 and core portion 22. Peripheral portion 20 is made of a closed cell foam having a hardness of from about 45 to about 50. Core portion 22 is made of a closed cell foam having a hardness of about 35. Peripheral portion 20 is a single piece, basically with the center cut out to accommodate core portion 22 which is another single piece, these pieces being joined in any conventional manner as by gluing. Alternatively, as shown in dotted lines in FIG. 1, peripheral portion 20 could comprise an upper portion 24 extending the full length of the shoe from the heel to the toe and lower portion 26 extending only from the heel of the shoe to approximately beneath the ball of the wearer's foot, in any event, well forward of the arch area. This alternate construction is merely for ease of manufacture rather than for any functional purpose affecting the use of the shoe. Attention is now directed to FIGS. 4 and 5 which show another embodiment of an intermdiate sole 18 according to the present invention. In this embodiment, intermediate sole 18 comprises peripheral portion 20 and core portion 22 as in the embodiment of FIGS. 2 and 3. Peripheral portion 20 is made of a foam having a hardness of from about 45 to about 50 and core portion 22 is made of a foam having a hardness of about 35. But, in order to provide additional support for the runner's foot in the ball area immediately behind the big toe, a generally oval area is cut out of core portion 22 and metatarsal portion 28 is inserted, metatarsal portion 28 also being made of a closed cell foam, but one having a hardness of about 40 to about 45.

Figure 6:
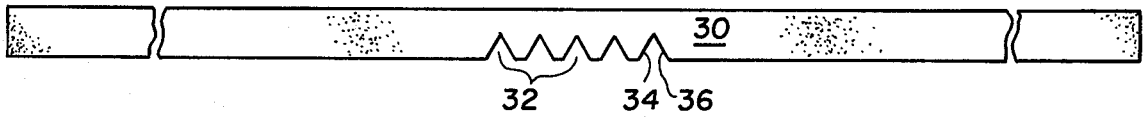
FIG. 6 is a top plan view of a blank for making a peripheral portion according to another embodiment of the present invention.
Figure 7:
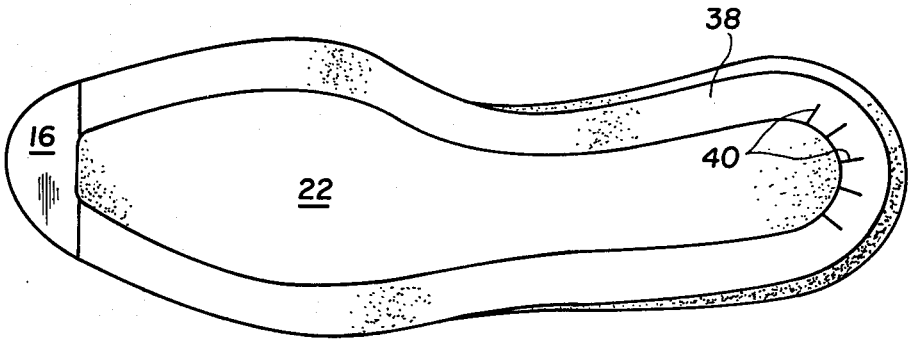
FIG. 7 is a top plan view of an intermediate sole using the blank of FIG. 6.

While there has been no description heretofore of the method of making these various foam components, it will be abundantly clear to one skilled in the art that these are made in a conventional manner, most economically by cutting sheets of foam, or blanks of the correct general shape, to the precise size and shape. Other alternative means which are known in the art could be used. For example, molds of the correct size and shape could be made and the foam produced in these molds. An alternative for making peripheral portion 20 is to use a linear blank which is generally cut to size and bending it to conform to the outer peripheral shape of the sole of the shoe after which it is cemented in place. Still another embodiment of this invention utilizes such a blank. Attention is directed to FIGS. 6 and 7 wherein blank 30 is shown. Blank 30 is of a length corresponding to the linear distance from the toe end of the shoe to the heel end, around the heel portion of the shoe, and back to the toe end. A plurality of notches 32 are cut in the central portion of the blank, thereby forming surfaces 34 and 36 in each notch. The blank 30 is then bent to form outer peripheral portion 38. Obviously, mating surfaces 34 and 36 will join and are to be cemented at the joint. These joints are designated by the numeral 40 in FIG. 7. It has been found that when blank 30 is made of a foam having a hardness of about 45, joints 40 will possess a hardness of about 50 to about 55. Thus, additional support is provided at the heel area of the shoe.

Figure 8:
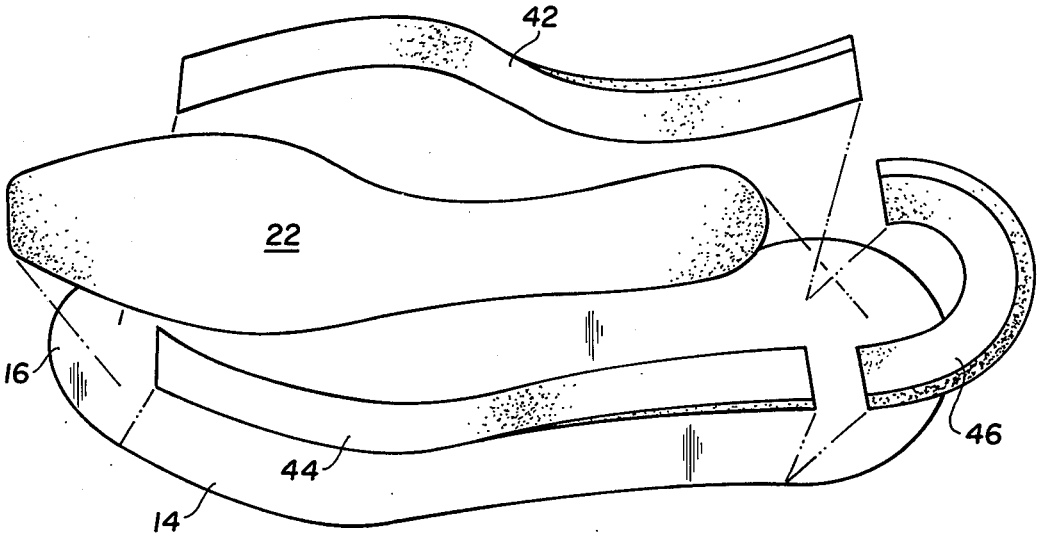
FIG. 8 is an exploded top plan view of an intermediate sole construction according to still another embodiment of the present invention.

In still another embodiment shown in FIG. 8, intermediate sole 18, instead of comprising a single outer peripheral portion and an inner core portion as in the preceding embodiments, also includes core portion 22. But, the peripheral portion surrounding core portion 22 comprises inner side member 42, outer side member 44, and heel member 46. It will be seen that the heel member 46 is generally U-shaped but with the inner leg of the U somewhat shorter than the outer leg. Inner side member 42, therefore, is correspondingly longer than outer side member 44. While core portion 22, as in the other embodiments, has a hardness of about 35, side members 42 and 44 each have a hardness of about 50 and heel member 46 has a hardness of about 40. This provides somewhat more resiliency and shock absorbing in the critical outer heel portion of the shoe.

The importance of the instant shoe construction will be apparent when the reader considers the action of the average foot in stride. The foot strikes the surface of the ground on the outside quarter of the heel with a tremendous impact. Weight is shifted along the outside edge of the foot to the ball of the foot, and is then transferred diagonally from the outside toward the inside ball, and then forward in the direction of the big toe. Thus, there is a necessity for reasonably firm support along the outer periphery of the shoe as a whole and it is for this reason that a relatively hard foam is used along the outer periphery. But, it also points out that it is not necessary for the interior portion of the wedge of the shoe to have the same firmness and weight that is needed on the outside. Thus, considerable weight can be saved by utilizing the construction of the instant invention wherein the interior portion utilizes a softer foam. In fact, core portion 22 need not be a solid piece but could be scraps or trimmings recovered from cutting other pieces.

The outer periphery can generally be described as being that area approximately one-half inch wide running along the edge of the net lasted bottom pattern.

While preferred materials have already been mentioned as being polyethylene or polyethylene vinyl acetate foam, any other material, or combination of materials, known in the art as having the proper hardness characteristics could be used. Typical such materials are rubber sponge for use in the peripheral portion and urethane foam, cork, or granulated ethylene vinyl acetate scrap with a binder, used for the core portion.

Thus, it will be apparent that the objects set forth at the outset have been successfully achieved by reference to the description of the preferred embodiments which are exemplary only and are set forth in an illustrative manner, the invention being described only by the appended claims.

What is claimed is:

1. An athletic shoe which is light in weight and provides firm support along the outer edges thereof comprising an upper, a hard resilient outer sole, and an intermediate sole which comprises a relatively hard closed cell foam peripheral portion along the entire longitudinal length of the shoe and underlying the outer periphery thereof, and a relatively soft closed cell foam core portion extending essentially along the entire longitudinal length of the shoe.

2. An athletic shoe as claimed in claim 1, wherein said peripheral portion is essentially U-shaped.

3. An athletic shoe comprising an upper; a hard, resilient outer sole extending longitudinally from the heel end to the toe and of said shoe and curved upwardly in front of the toe portion of the shoe; and a wedge-shaped intermediate sole member extending longitudinally and tapering from the heel end to the sole end which comprises:

(A) an outer peripheral portion fabricated of a closed cell foam having a hardness of from about 45 to about 50, and surrounding (B) a core portion fabricated of a closed cell foam having a hardness of about 35.

4. An athletic shoe as claimed in claim 3, wherein the portion of said core portion underlying the ball of the wearer's foot in the region of the big toe is fabricated of a closed cell foam having a hardness of from about 40 to about 45.

5. An athletic shoe as claimed in claim 3, wherein said outer peripheral portion is fabricated of a unitary blank having a plurality of notches cut out from one edge and spaced about the transverse axis thereof, being bent at the notches to form the heel end of said outer peripheral portion and having the thus mated sides of the notches glued, whereby the glued notches form an area having a hardness of about 50 to about 55.

6. An athletic shoe as claimed in claim 3, wherein said outer peripheral portion comprises a heel portion and a pair of forwardly extending side portions joined thereto, said heel portion having a hardness of about 40 and said side portions having a hardness of about 50.

* * * * *